US010505299B2

(12) United States Patent
Zhao et al.

(10) Patent No.: US 10,505,299 B2
(45) Date of Patent: Dec. 10, 2019

(54) ELECTRICAL CONNECTOR HAVING AN IMPROVED METAL SHELL WITH A SOLDERING PORTION

(71) Applicant: FOXCONN INTERCONNECT TECHNOLOGY LIMITED, Grand Cayman (KY)

(72) Inventors: Jun Zhao, Huaian (CN); Cai-Yun Zhang, Huaian (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 16/109,767

(22) Filed: Aug. 23, 2018

(65) Prior Publication Data

US 2019/0067846 A1 Feb. 28, 2019

(30) Foreign Application Priority Data

Aug. 24, 2017 (CN) ..... 2017 1 0735076

(51) Int. Cl.

| | |
|---|---|
| ***H01R 12/57*** | (2011.01) |
| ***H01R 13/648*** | (2006.01) |
| ***H01R 13/502*** | (2006.01) |
| ***H01R 4/02*** | (2006.01) |
| ***H01R 13/405*** | (2006.01) |
| ***H01R 12/70*** | (2011.01) |
| *H01R 24/60* | (2011.01) |
| *H01R 107/00* | (2006.01) |

(52) U.S. Cl.

CPC ..... *H01R 12/57* (2013.01); *H01R 4/02* (2013.01); *H01R 12/707* (2013.01); *H01R 13/405* (2013.01); *H01R 13/502* (2013.01); *H01R 24/60* (2013.01); *H01R 2107/00* (2013.01)

(58) Field of Classification Search

CPC ..... H01R 13/6594; H01R 13/6582; H01R 13/514; H01R 12/716; H01R 12/724

See application file for complete search history.

(56) References Cited

U.S. PATENT DOCUMENTS

| | | | | |
|---|---|---|---|---|
| 9,537,272 | B2 * | 1/2017 | Chien | H01R 24/62 |
| 9,742,121 | B2 * | 8/2017 | Hayashi | H01R 13/6585 |
| 9,923,317 | B2 * | 3/2018 | Yao | H01R 13/6594 |
| 2018/0151987 | A1 * | 5/2018 | Zhao | H01R 13/506 |

FOREIGN PATENT DOCUMENTS

| | | | |
|---|---|---|---|
| CN | 204538337 | U | 8/2015 |
| CN | 205921158 | U | 2/2017 |
| CN | 107204527 | A | 9/2017 |
| CN | 107465014 | A | 12/2017 |

* cited by examiner

*Primary Examiner* — Xuong M Chung Trans

(74) *Attorney, Agent, or Firm* — Wei Te Chung; Ming Chieh Chang

(57) ABSTRACT

An electrical connector includes a contact module and a metal shell enclosing the contact module. The contact module includes an insulative housing and a number of conductive terminals affixed to the insulative housing. The metal shell includes a top wall, a bottom wall, a pair of lateral walls connecting the top wall and bottom wall for forming a receiving room. The metal shell further includes a pair of soldering portions vertically disposed at a rear edge of the lateral walls. Each soldering portion includes a beginning portion connected integrally with the lateral wall and a free-end portion spaced apart from the lateral wall in a transverse direction to form a gap.

17 Claims, 9 Drawing Sheets

ELECTRICAL CONNECTOR HAVING AN IMPROVED METAL SHELL WITH A SOLDERING PORTION

BACKGROUND OF THE DISCLOSURE

1. Field of the Disclosure

The present disclosure relates to an electrical connector, and more particularly to an electrical connector capable of providing enough strength to be fixed in a printed circuit board.

2. Description of Related Arts

China Patent No. 205921158 discloses an electrical connector having a metallic shell with an un-torn, outwardly extending soldering portion, which, due to frequent use, results in insufficient strength of solder joint and is prone to breakage, thus affecting performance of the electrical connector. In the prior art, a pair of soldering legs extend outwardly from both sides of the shielding shell of the electrical connector but the grabbing force is insufficient. The grabbing force of the soldering portion need be increased without increasing the size of the electrical connector in the insertion direction.

An improved electrical connector is desired.

SUMMARY OF THE DISCLOSURE

Accordingly, an object of the present disclosure is to provide an electrical connector capable of providing enough strength to be fixed in a printed circuit board.

To achieve the above object, an electrical connector includes a contact module and a metal shell enclosing the contact module. The contact module includes an insulative housing and a number of conductive terminals affixed to the insulative housing. The metal shell includes a top wall, a bottom wall, and a pair of lateral walls connecting the top wall and bottom wall for forming a receiving room. The metal shell further includes a pair of soldering portions vertically disposed at a rear edge of the lateral walls. Each soldering portion includes a beginning portion connected integrally with the lateral wall and a free-end portion spaced apart from the lateral wall in a transverse direction to form a gap.

Other objects, advantages and novel features of the disclosure will become more apparent from the following detailed description when taken in conjunction with the accompanying drawings.

DETAILED DESCRIPTION OF THE PREFERRED EMBODIMENT

Figure 1:
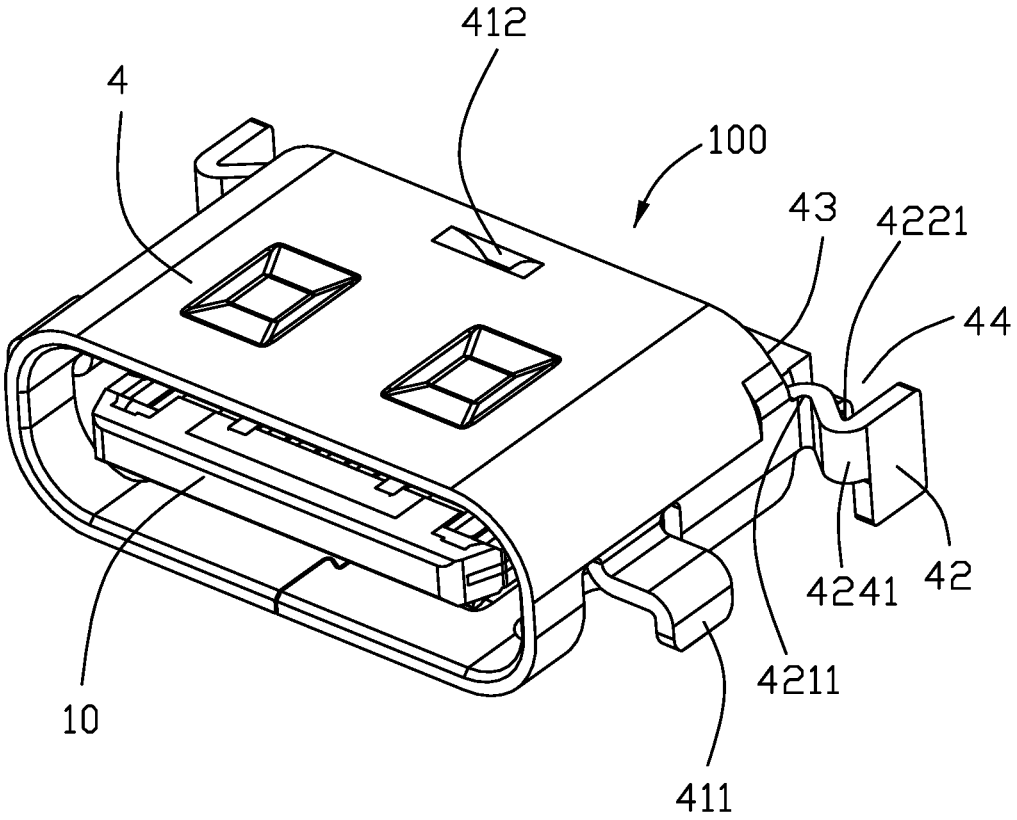
FIG. 1 is a perspective, assembled view of an electrical connector.
Figure 2:
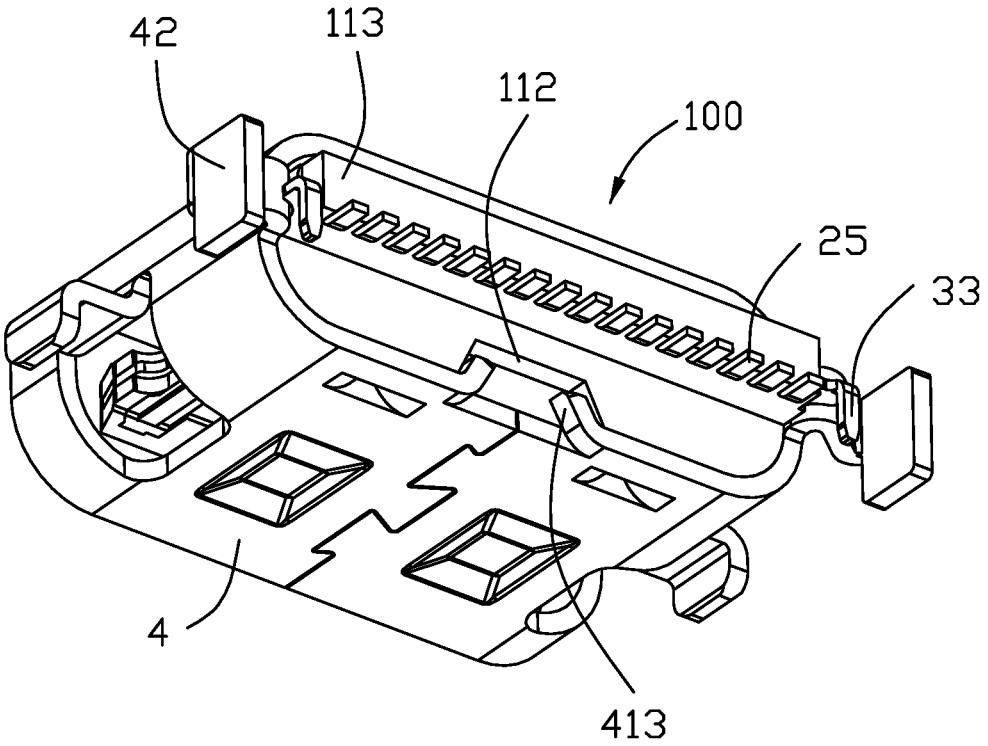
FIG. 2 is another assembled view taken from FIG. 1.

Reference will now be made in detail to the embodiments of the present disclosure. The invention relates to an electrical connector mounted to a printed circuit board. The electrical connector includes a contact module 10 and a metal shell 4 enclosing the contact module 10.

Referring to FIGS. 5 to 9, the contact module 10 includes an insulative housing 1, a number of conductive terminals 2 affixed to the insulative housing a and arranged in two rows, and a pair of shielding plates 3 affixed to the insulative housing 1. The insulative housing 1 includes a first insulator 13 and a second insulator 14. The insulative housing 1 includes a base portion 11 and a tongue portion 12 extending forwardly from the base portion 11. The tongue portion 12 includes a pair of mating grooves 121 located laterally and mated with a mating electrical connector. The base portion 11 includes a number of resisting recesses 111 recessed in a front end thereof, a pair of locking grooves 112, and a rear portion 113 located at a rear end. The rear portion 113 includes a pair of first lateral portions 1131 recessed in a front end, a pair of second lateral portions 1132 located at a rear end of the first lateral portions 1131, and a pair of third lateral portions 1133 located at a rear end of the second lateral portions 1132.

Figure 8:
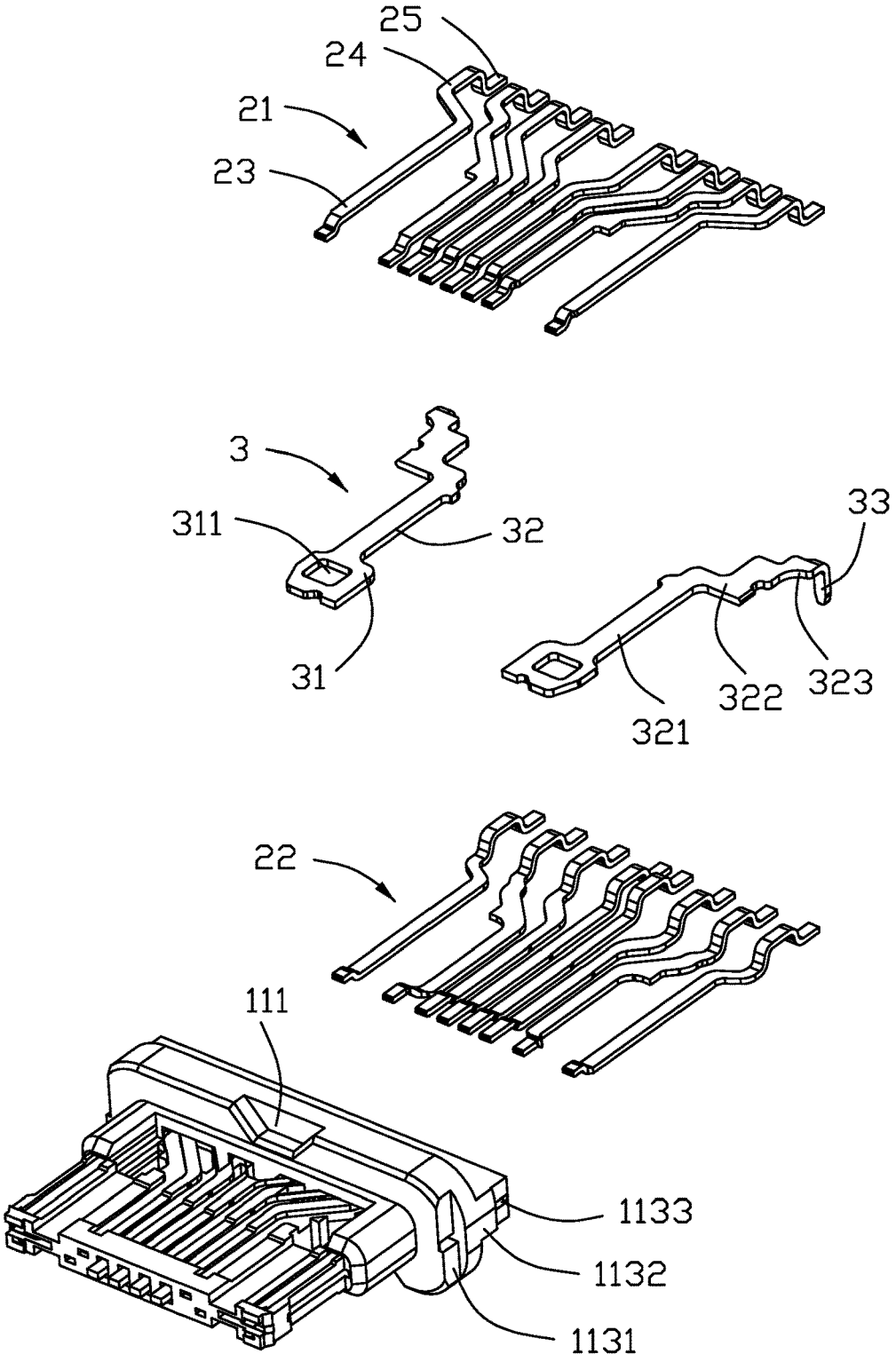
FIG. 8 is an exploded view of the conductive terminals, the shielding plate and the first insulator of the electrical connector.
Figure 9:
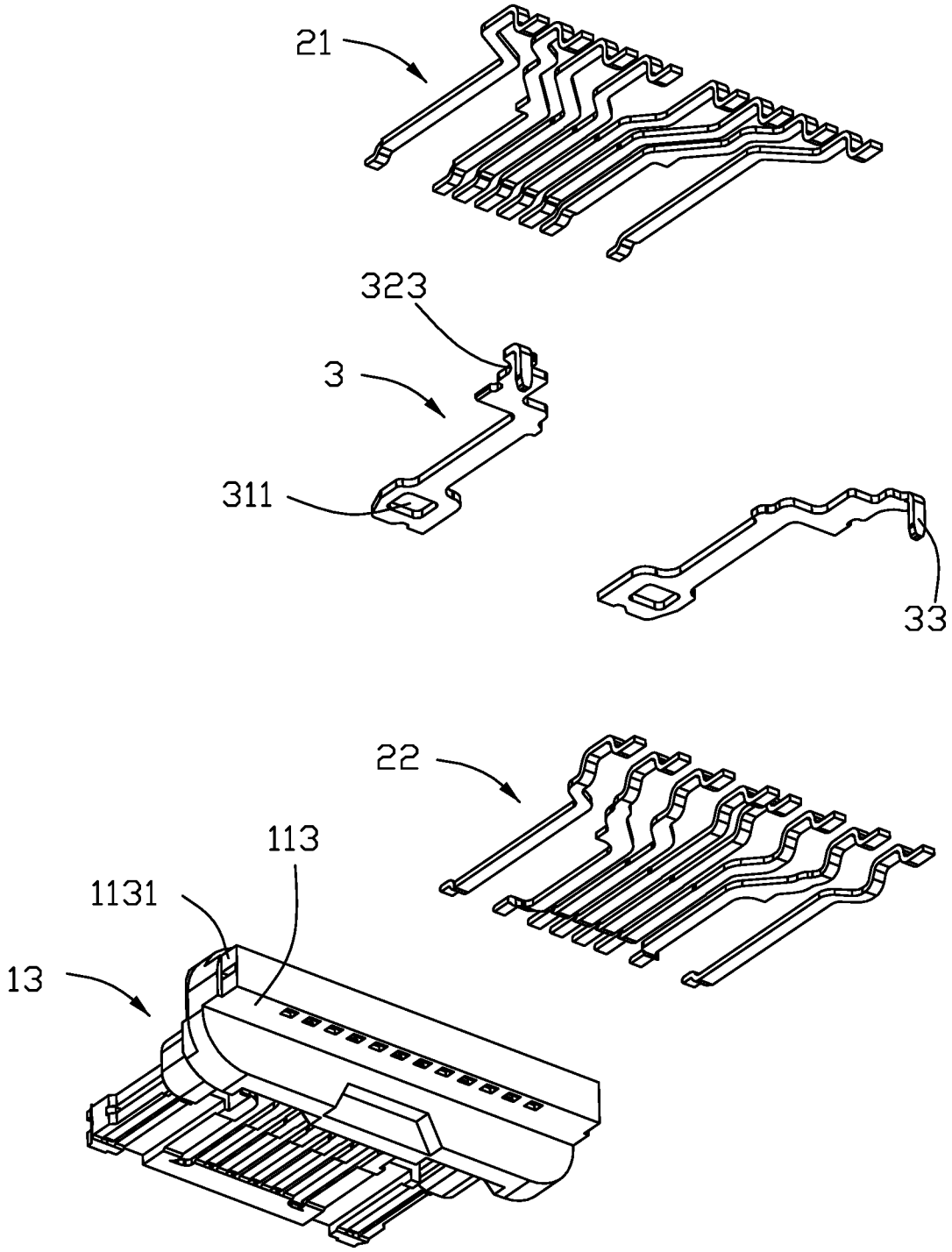
FIG. 9 is another exploded view of the electrical connector taken from FIG. 8.

Referring to FIGS. 8 to 9, the conductive terminals 2 include a row of upper terminals 21 and a row of lower terminals 22. Each terminal 2 includes a contacting portion 23 exposed to the tongue portion 12, a tail 25 extending outwardly from the base portion 11, and a fixed portion 24 connecting the contacting portion 23 and the tail 25 and embedded in the base portion 11.

Referring to FIGS. 8 to 9, each shielding plate 3 includes a front portion 31 sandwiched between the upper terminal 21 and the lower terminal 22, a soldering pin 33 extending laterally from the base portion 11, and a connecting arm 32 connecting the front portion 31 and the soldering pin 33. The front portion 31 includes a locating hole 311 embedded in the tongue portion 12. The connecting arm 32 includes an extending arm 321 arranged in vertically and extending in a lengthwise direction, a protrusion 322 bending laterally and vertically from the extending arm 321, and an arc resisting portion 323 protruding from the protrusion 322. The shielding plate 3 protrudes laterally from the mating groove 121 and is mated with the mating electrical connector. The soldering pins 33 are located laterally at the tails 25 of the outermost conductive terminal 2.

Referring to FIGS. 1 to 7, the metal shell 5 encloses the contact module 10. The metal shell 5 includes a top wall, a bottom wall opposite to the top wall, and a pair of lateral walls connecting the top wall and the bottom wall for forming a receiving room. The metal shell 5 includes a main portion 41 shaped as a cylindrical part, a pair of fixed pins 411 torn apart from the bottom wall and located beside the lateral walls, and a pair of soldering portion 42 extending rearward integrally and disposed vertically at the printed circuit board. The main portion 41 includes an inner wall 414 and an outer wall 415. The main portion 41 includes a number of resisting tubers 412 resisting against the resisting recesses 111, and a pair of locking portions 413 bending upwardly from a rear end of the main portion 41 and locked with the locking grooves 112. The fixed pins 411 bend downwardly from the lateral walls and are affixed to the printed circuit board. In the preferred embodiment, the soldering portions 42 extend outwardly from a rear edge of the main portion 41 and bend laterally. The distance between the pair of soldering portions 42 is not larger than that of the pair of fixed pins 411 in a transverse direction. In other embodiments, the soldering portions 42 are torn apart from the edge of the lateral walls and bend laterally. There exists an arc angle 43 between the top wall and the lateral wall. The soldering portion 42 is at least partially disposed at the arc angle 43. The soldering portion 42 includes a beginning portion connected integrally with the lateral wall and a free-end portion spaced apart from the lateral wall in the transverse direction to form a gap 44. In the preferred embodiment, the soldering portion 42 is spaced apart from the lateral wall except the beginning portion. In other embodiment, the soldering portion 42 connects with the lateral wall of the metal shell 5 except the free-end portion. the soldering portion 42 includes a first bending portion 421 having a first opening 4211 and extending integrally from a rear end of the main portion 41, a second bending portion 422 having a second opening 4221 and located at a free end of the first bending portion 421, and a soldering arm 4241 extending downwardly and vertically from the second bending portion 422. The first opening 4211 and the second opening 4221 face opposite to form a "S-shaped" structure. In the preferred embodiment, the soldering arm 4241 extends along a front-to-rear direction from a free end of second bending portion 422. In other embodiment, the soldering arm 4241 extends along a rear-to-front direction. The length of the soldering portion 42 in a lengthwise direction perpendicular to the transverse direction is 1.17 mm, and the gap is 1.1 mm.

Figure 3:
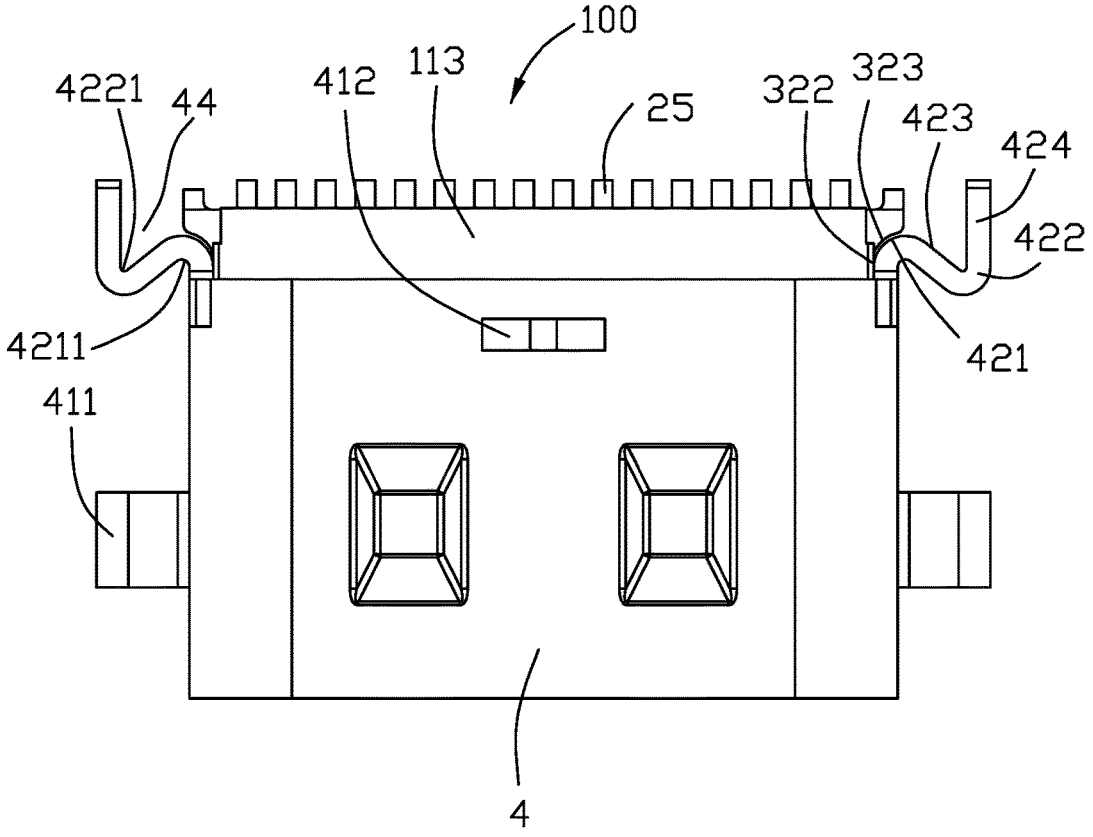
FIG. 3 is a top view of the electrical connector.
Figure 4:
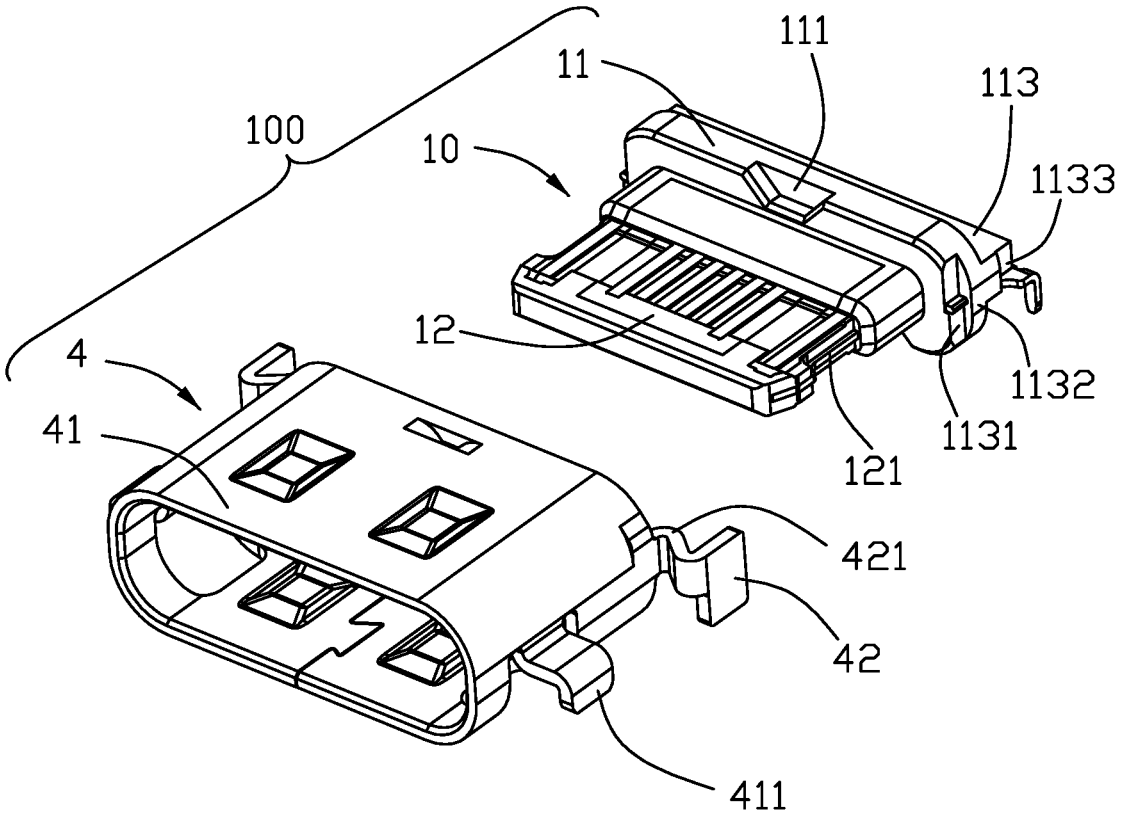
FIG. 4 is a partial exploded view of the electrical connector.
Figure 5:
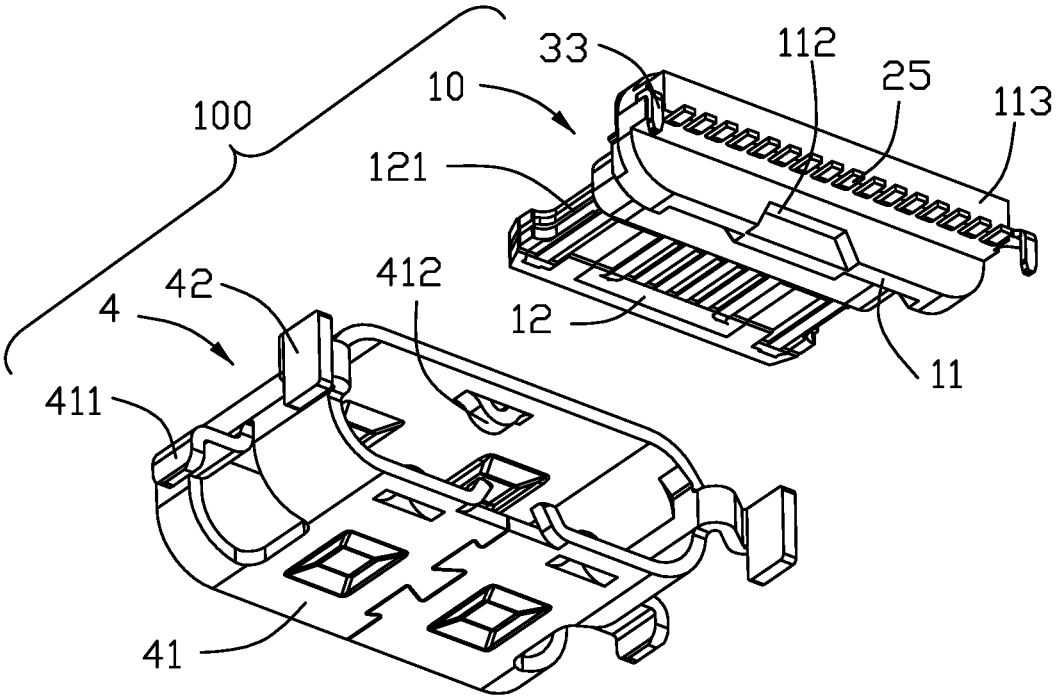
FIG. 5 is another exploded view of the electrical connector taken from FIG. 4.
Figure 6:
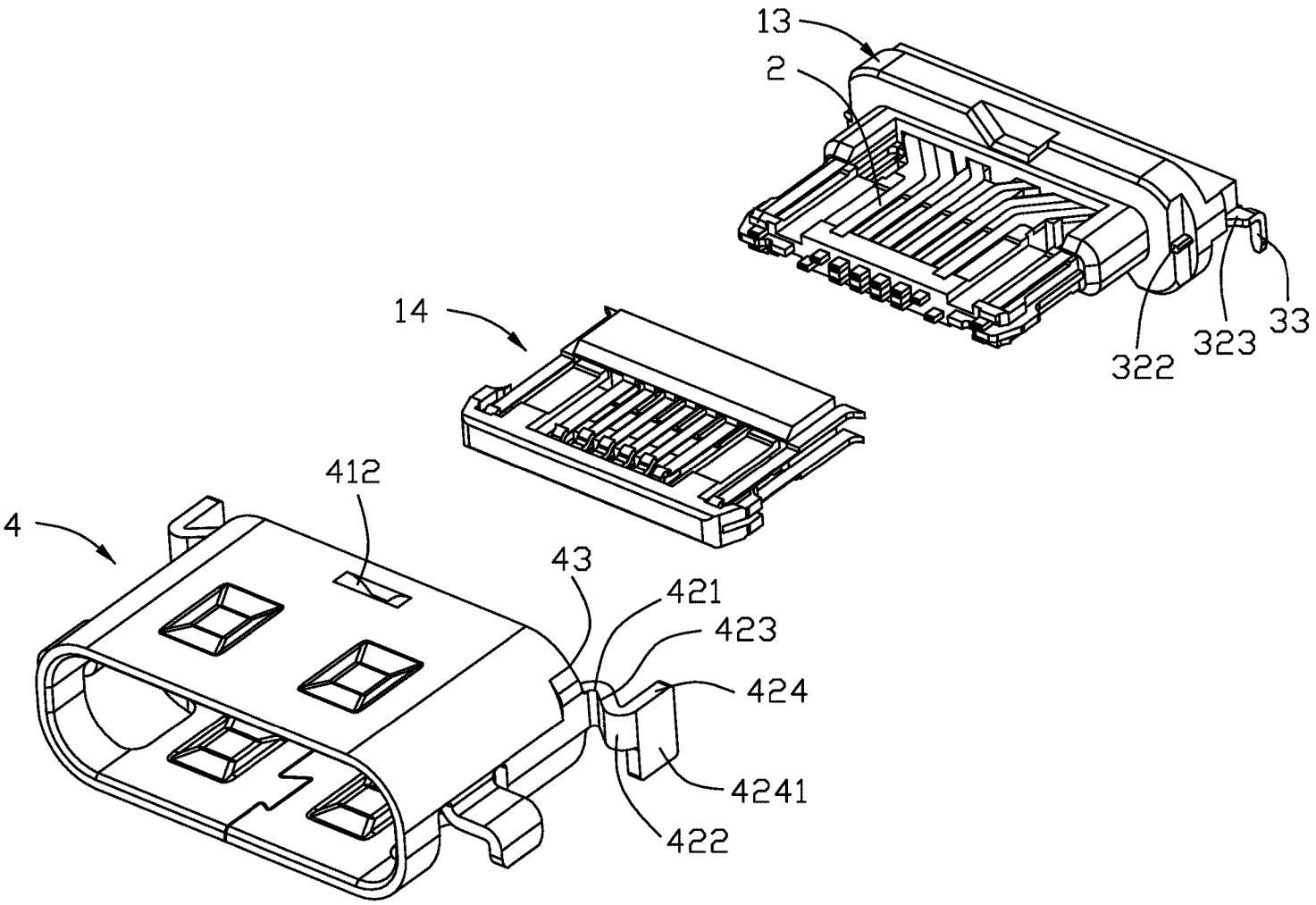
FIG. 6 is an exploded view of the electrical connector.
Figure 7:
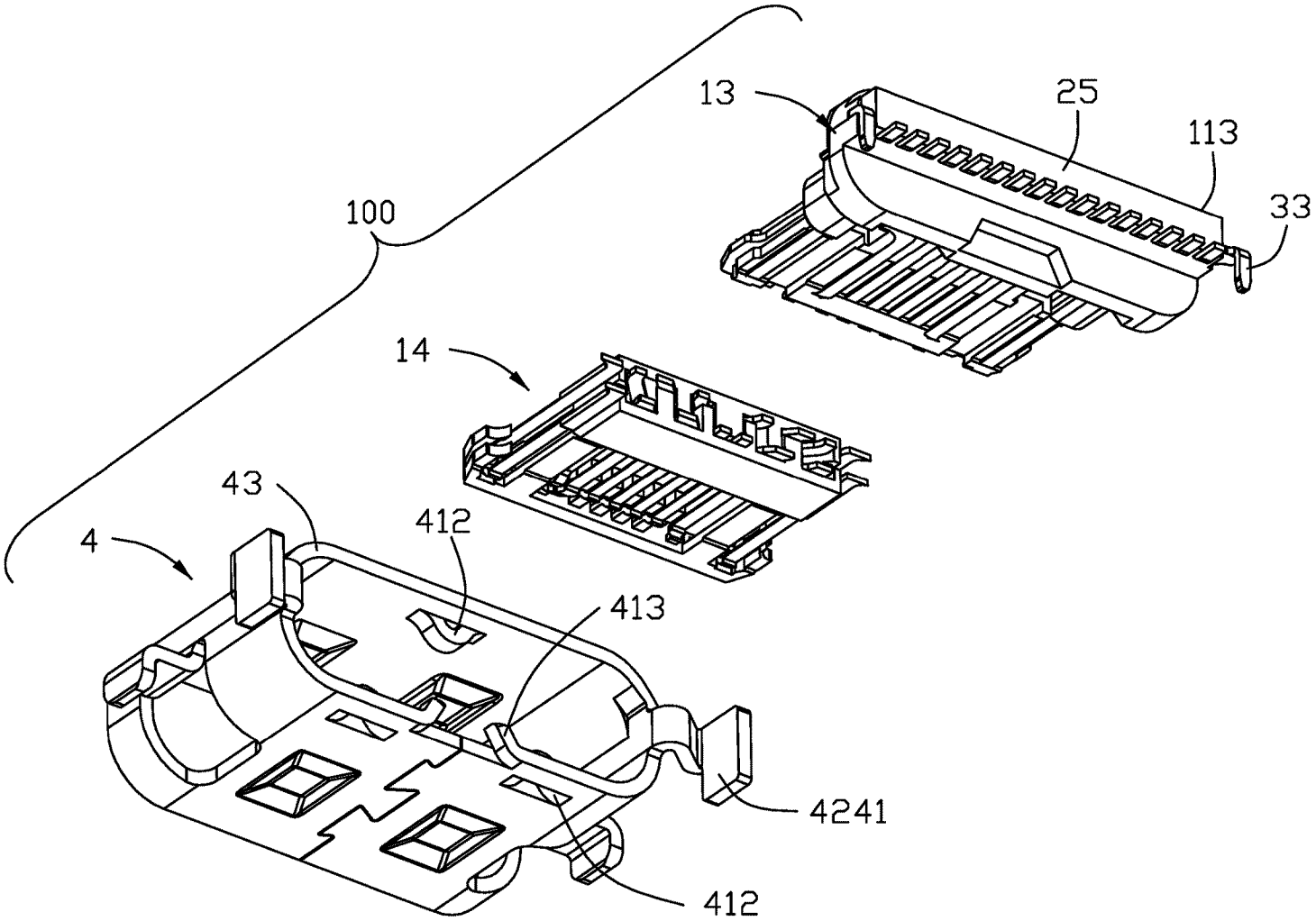
FIG. 7 is another exploded view of the electrical connector taken from FIG. 6.

The soldering portion 42 includes a connecting beam 423 connecting the first bending portion 421 and the second bending portion 422, and an extending beam 424 extends rearward from the second bending portion 422. The connecting beam 424 extends in an oblique angle between thirty degrees and eighty degrees. The soldering arm 4241 is formed to extend vertically and downwardly from the bottom of the extending beam 424. The planes of the first bending portion 421, the second bending portion 422, the connecting beam 423 and the extending beam 424 are perpendicular to the printed circuit board. The first bending portion 421, the second bending portion 422, the connecting beam 423, and the extending beam 424 are "S" shaped as viewed from above, as shown in FIG. 3.

In the manufacturing process of the electrical connector, the upper terminals 21, the shielding plates 3, the lower terminals 22, and the insulative materials are integrally molded, and the first insulator 13 is formed in the process. Then, the molded module is glued to form the contact module 10. A second insulator 14 is formed during the filling process. Finally, the contact module 10 is assembled to the metal shell 4 from the rear-to-front direction. In the process of forming the contact module, the soldering pins 33 of the shielding plates 3 are located laterally at the tail 25 of the outermost conductive terminal 2. The protrusion 322 is fixed to the first lateral portion 1131 and protrudes laterally from the first lateral portion 1131. The arc resisting portion 323 is retained by the second lateral portion 1132 and the third lateral portion 1133 and protrudes laterally from the second lateral portion 1132 and the third lateral portion 1133. After the contact module 10 is assembled into the metal shell 4, the protrusion 322 abuts against the inner wall surface 414. The arc resisting portion 323 resists against the first bending portion 421.

Compared with the prior art, the electric connector is provided with a pair of soldering portions 42 bent in an "S" shape at the rear end of the metal shell 4, and the width of the soldering portion 42 in the transverse direction is increased, and the square with the printed circuit board is increased without changing the length dimension of the electrical connector making the electrical connector more stable on the printed circuit board. Understandably, on one hand the soldering arm 4241 requires to be large enough along the front-to-back direction for enhancement of the soldering effect while on the other hand the soldering arm 4241 should not extend beyond the tail 25 in the front-to-back direction in a side view for assuring the whole connector is located in the predetermined confined area. It is noted that a rear edge of the soldering arm 4241 is essentially aligned with rear end of the tails 25 of the terminals 2 in the transverse direction. One feature of this invention is that the connecting beam 423 extends obliquely relative to the front-to-back direction rather than perpendicular thereto so as to not only lengthen the dimension of the soldering arm 4241 along the front-to-back direction but also lengthen itself in the extension direction for enhancement of the resiliency thereof. Notably, the soldering arm 4241 and the connecting beam 423 commonly form an acute angle therebetween, and the dimension of the soldering arm 4241 in the front-to-back direction is not less than a distance between rear ends of tails 25 of the contacts/terminals 2 and a rear edge of the main body 41 of the metal shell 5 along the front-to-back direction in a top view.

While four preferred embodiments in accordance with the present disclosure have been shown and described, equivalent modifications and changes known to persons skilled in the art according to the spirit of the present disclosure are considered within the scope of the present disclosure as described in the appended claims.

What is claimed is:

1. An electrical connector comprising:

a contact module comprising an insulative housing and a plurality of conductive terminals affixed to the insulative housing; and a metal shell enclosing the contact module and comprising a top wall, a bottom wall, a pair of lateral walls connecting the top wall and bottom wall for forming a receiving room, and a pair of soldering portions vertically disposed at a rear edge of the lateral walls; wherein each soldering portion comprises a beginning portion connected integrally with the lateral wall and a free-end portion spaced apart from the lateral wall in a transverse direction to form a gap; and the soldering portion comprises a first bending portion having a first opening and extending integrally from the rear edge of the metal shell, a second bending portion having a second opening and extending from the first bending portion, and a soldering arm extending downwardly and vertically from the second bending portion, and the first opening and the second opening face opposite to form a S-shaped structure.

2. The electrical connector as claimed in claim 1, wherein the soldering portion is spaced apart from the lateral wall except the beginning portion.

3. The electrical connector as claimed in claim 1, wherein the insulative housing comprises a base portion, a tongue portion extending forwardly from the base portion, and a rear portion extending rearward outwardly from the metal shell, each conductive terminal comprises a contacting portion exposed to the tongue portion, a fixed portion affixed to the base portion, and a tail extending outwardly from the rear portion, and the soldering portions are located laterally at the tail in the transverse direction.

4. The electrical connector as claimed in claim 1, wherein the soldering arm extends rearward from the second bending portion.

5. The electrical connector as claimed in claim 1, wherein the soldering portion is torn apart from the rear edge of the lateral wall of the metal shell and then bends downwardly, there exists an arc angle between the top wall and the lateral wall, and the soldering portion is at least disposed at the arc angle.

6. The electrical connector as claimed in claim 1, wherein the soldering portion extends outwardly from the rear edge of the lateral wall and bends downwardly.

7. The electrical connector as claimed in claim 1, wherein the metal shell comprises a pair of fixed pins torn apart from two lateral sides of the bottom wall, and the distance between the pair of soldering portions is smaller than that of the pair of the fixed pins in the transverse direction.

8. The electrical connector as claimed in claim 1, wherein the soldering portion comprises a connecting beam connecting the first bending portion and the second bending portion, and the connecting beam extends in an oblique angle.

9. The electrical connector as claimed in claim 8, wherein the angle is between thirty degrees and eighty degrees, the length of the soldering portion in a lengthwise direction is 1.17 mm, and the gap is 1.1 mm.

10. An electrical connector comprising:

a contact module including an insulative housing with a plurality of contacts secured thereto; and a metallic shell secured to the contact module and including a cylindrical main portion enclosing the contact module, and a pair of soldering portions extending from two opposite transverse sides of a rear edge of said main portion; wherein each of said soldering portions includes a soldering arm lying in a vertical plane along a front-to-back direction and spaced from the main portion in a transverse direction perpendicular to the transverse direction with a gap, and a connecting beam linked between a rear edge of the main portion and the soldering arm and extending in an oblique direction angled to the front-to-back direction and the transverse direction; and a first bending portion is unitarily formed between the rear edge of the main portion and the connecting beam, and a second bending portion is unitarily formed between the connecting beam and the soldering arm.

11. The electrical connector as claimed in claim 10, wherein said connecting beam and said soldering arm commonly form an acute angle therebetween in a top view.

12. The electrical connector as claimed 10, wherein a rear edge of the soldering arm is essentially aligned with rear ends of tails of the contacts in the transverse direction.

13. The electrical connector as claimed in claim 10, wherein a dimension of the soldering arm along the front-to-back direction is not less than a distance between rear ends of tails of the contacts and said rear edge of the main body in a top view.

14. The electrical connector as claimed in claim 10, wherein the soldering arm, the second bending arm, the connecting beam, the first bending arm and a rear edge region of the main portion commonly form an S configuration in a top view.

15. The electrical connector as claimed in claim 10, wherein the first bending portion and the second bending portion form corresponding acute angles with a same amount while directing to opposite directions.

16. An electrical connector comprising:

a contact module comprising an insulative housing and a plurality of conductive terminals affixed to the insulative housing; and a metal shell enclosing the contact module and comprising a top wall, a bottom wall, a pair of lateral walls connecting the top wall and bottom wall for forming a receiving room, and a pair of soldering portions vertically disposed at a rear edge of the lateral walls; wherein each soldering portion comprises a beginning portion connected integrally with the lateral wall and a free-end portion spaced apart from the lateral wall in a transverse direction to form a gap; and the soldering portion comprises a first bending portion having a first opening and extending integrally from the rear edge of the metal shell, a second bending portion having a second opening and located at a free end of the first bending portion, and a soldering arm extending downwardly and vertically from the second bending portion, the soldering portion further comprises a connecting beam connecting the first bending portion and the second bending portion along a rear-to-front direction perpendicular to the transverse direction, and the connecting beam extends in an oblique angle.

17. The electrical connector as claimed in claim 16, wherein the oblique angle is between thirty degrees and eighty degrees, the length of the soldering portion in a lengthwise direction is about 1.17 mm, and the gap is about 1.1 mm.

* * * * *